US007577488B2

(12) United States Patent
Okamoto

(10) Patent No.: US 7,577,488 B2
(45) Date of Patent: Aug. 18, 2009

(54) KNITTING METHOD OF KNITTED FABRIC

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 72 days.

(21) Appl. No.: 11/720,559

(22) PCT Filed: Nov. 29, 2005

(86) PCT No.: PCT/JP2005/021916

§ 371 (c)(1),
(2), (4) Date: May 31, 2007

(87) PCT Pub. No.: WO2006/059616

PCT Pub. Date: Jun. 8, 2006

(65) Prior Publication Data

US 2008/0190147 A1 Aug. 14, 2008

(30) Foreign Application Priority Data

Dec. 1, 2004 (JP) ..... 2004-349162

(51) Int. Cl.
*D04B 7/10* (2006.01)

(52) U.S. Cl. ..... 700/141; 66/176; 66/64

(58) Field of Classification Search ..... 66/64, 66/69, 70, 176, 171, 172 R; 700/130, 141
See application file for complete search history.

(56) References Cited

U.S. PATENT DOCUMENTS 5,692,399 A 12/1997 Takahashi et al.
5,987,930 A 11/1999 Nakai
6,658,599 B1 * 12/2003 Linam et al. ..... 714/25
7,181,309 B2 * 2/2007 Kazuyoshi ..... 700/141
7,212,881 B2 * 5/2007 Kazuyoshi ..... 700/141
7,222,504 B2 * 5/2007 Nakayama ..... 66/64

(Continued)

FOREIGN PATENT DOCUMENTS

JP 2005-120550 A 5/2005

*Primary Examiner*—Danny Worrell
(74) *Attorney, Agent, or Firm*—Rothwell, Figg, Ernst & Manbeck, P.C.

(57) ABSTRACT

A knitting method for knitting a tubular knitting fabric having gores of front and back knitted fabric parts which are different in size in the manner that no twisting of loops can be provided at the stage of the completion of the joining of the gores so that the tubular knitted fabric can be knitted up continuously without any need of rotation operation. A position of a reference boundary at the stage of the start of the knitting of the tubular knitted fabric is preset so that even when a boundary of the front and back knitted fabric parts on the joining side is located between the front and back needle beds via rotation operation at the stage of the start of the joining of the tubular knitted fabrics to form the gore therebetween, the reference boundary of the front and back knitted fabric parts on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric.

4 Claims, 4 Drawing Sheets

U.S. PATENT DOCUMENTS

2003/0106344 A1 6/2003 Okamoto
2005/0028562 A1 2/2005 Urano et al.
2006/0248928 A1 11/2006 Kazuyoshi

* cited by examiner

KNITTING METHOD OF KNITTED FABRIC

CROSS REFERENCE TO RELATED APPLICATION

This application is a 35 USC § 371 National Phase Entry Application from PCT/JP2005/021916, filed Nov. 29, 2005, and designating the United States.

TECHNICAL FIELD

The present invention relates to a knitting method of a knitted fabric formed by joining together two or more tubular knitted fabrics so that a gore can be formed therebetween.

BACKGROUND ART

Many knitted garments such as sweaters and pants are formed by two or more tubular knitted fabrics being knitted respectively and joined together at a part thereof. Some knitted garments have a so-called gore(s) at joining parts of the tubular knitted fabrics (e.g. at side parts of the sweater, at a crotch of the pants, etc.).

By forming the gores at the joining parts of the tubular knitted fabrics, the knitted garment formed from plane knitted fabrics is shaped in three dimensions, whereby the knitted garment comfortable to wear and suit one's figure is obtained.

The applicant of this application already proposed a joining method for joining together the tubular knitted fabrics so that the gores can be formed at the joining parts thereof (disclosed by Patent Document 1). The Patent Document 1 discloses the joining method when a gore portion of a front knitted fabric and a gore portion of a back knitted fabric which are equal in length to each other. Specifically, front knitted fabric parts of the tubular knitted fabrics and back knitted fabric parts of the same are respectively overlapped with each other so that loops of their gore portions located adjacent each other with respect to the boundary between the front knitted fabric part and the back knitted fabric part are overlapped with each other and loops of their gore portions located far away from each other with respect to the boundary are overlapped with each other; and then are subjected to the bind-off process, thereby forming the gores at the joining portions of the tubular knitted fabrics. This knitting method for the knitted fabrics having the gores enabled to provide the knitwear of a high freedom of body movement.

Patent Document 1: Pamphlet of International Publication No. 01/88243

DISCLOSURE OF THE INVENTION

Problem to be Solved by the Invention

In this connection, taking one's body movement in consideration, the knitted fabric having the gores such as the sweater, for example, should be knitted in the manner that the gore of the front knitted fabric part is made larger than that of the back knitted fabric part, for further improved comfortableness for the knitwear.

In order to make the gore of the front knitted fabric part larger than that of the back knitted fabric part, the number of wales of the gore of the front body part at a joining region thereof to a front sleeve part must be increased over the number of wales of the gore of the back body part at a joining region thereof to a back sleeve part.

However, when the front and back knitted fabrics are joined together, with the number of wales of the gore of the front knitted fabric part varied from that of the back knitted fabric part, the knitted fabric part having a narrow gore (in the case of the sweater, the back knitted fabric part of the sleeve) comes to be larger in horizontal length than the knitted fabric part having a wide gore (in the case of the sweater, the front knitted fabric part of the sleeve) at the completion of formation of the gores. It is desirable for the knitting that the number of loops (knitting widths) of the front and back knitted fabrics held on the front and back needle beds, respectively, are made substantially equal to each other. It is common, therefore, that one knitted fabric part (e.g. the back knitted fabric part) which comes to be larger in horizontal length at the completion of formation of the gore is rotated so that a part of the loops of the one knitted fabric part on the back needle bed located at an end portion of the knitting width on the side opposite to the joining side are transferred to the needles of the opposite needle bed (the front needle bed).

This rotation operation provides the result that the loops which were held on the needles of the back needle bed before the formation of the gore remain held on the needles of the front needle bed after the formation of the gore. When new loops are formed on those loops after the formation of the gore, the new loops are formed thereon, leaving the loops which were on the back needle bed before the joining process down on the needles of the front needle bed.

When transferred to the front needle bed, the loops which were on the back needle bed are transferred to the needles of the front needle bed in the twisted state. When the new loops are formed on those twisted loops, the twisted loops are fixed. This causes reduction of the commercial value of the garment undesirably. In particular, the twisted loops appear in the visible places of the sleeves undesirably.

Accordingly, a knitting technique was proposed as a way to prevent such a twist, according to which in advance of the rotation, the loops are preliminarily twisted in a direction for the twist to be eliminated, followed by the transference of the loops. This way of pre-twisting the loops in advance of the rotation enables the twist of the loops to be prevented by transferring the pre-twisted loops to the opposite needle bed when the gore parts are jointed together.

Another knitting technique to prevent the twist of the loops was also proposed for a garment such as, for example, a sweater having sleeves and a body which is knitted in the manner that after completion of the joining of the gore parts, the three tubular knitted fabric parts are jointed together to form a single tubular knitted fabric, followed by knitting up the single tubular knitted fabric. According to this knitting technique, the single tubular knitted fabric is rotated so that a boundary between a front knitted fabric part of one of the sleeves and a back knitted fabric part of the same is positioned between the front needle bed and the back needle bed, first. Then, the one sleeve and body is knitted up in a turn-back manner (C-shaped knitting) by only a predetermined number of courses, while being joined together. Thereafter, the single tubular knitted fabric is rotated so that the boundary of a front knitted fabric part of the other sleeve and a back knitted fabric part of the same is positioned between the front needle bed and the back needle bed. Then, the other sleeve and body is knitted up in the turn-back manner (C-shaped knitting) by only a predetermined number of courses, while being joined together. Then, the knitting processes mentioned above are repeated, to form the knitted fabric after the formation of the gores.

This knitting technique can allow the body and the sleeves to be knitted up, while being joined together, without twisting of the loops being provided after the formation of the gores. However, this knitting technique has the disadvantages that during the knitting of the one sleeve, the knitting of the other sleeve cannot be performed and, in addition, every time the one sleeve and the other sleeve are alternately knitted, the knitted fabric must be rotated.

Accordingly, it is an object of the present invention to provide a knitting method of a knitted fabric that can provide no twisting of the loops (stitches) at the completion of the joining of the gores and also can allow the tubular knitted fabric to be knitted up continuously without any need of rotation of the tubular knitted fabric after the completion of the joining of the gores.

Means for Solving the Problem

A knitting method of a knitted fabric of the present invention is a knitting method for knitting a knitted fabric having at least two tubular knitted fabrics, each comprising a front knitted fabric part and a back knitted fabric part which are continuously formed in a tubular form, wherein the front knitted fabric parts and the back knitted fabric parts are respectively joined with each other from their lateral ends so that a gore can be formed therebetween, and after the formation of the gore, the knitted fabric whose front knitted fabric part and back knitted fabric part are of different in length of the gore can be knitted to prevent twisting of loops.

The knitting method of the present invention is a knitting method for knitting the above-said knitted fabric by using a flat knitting machine having at least a pair of front and back needle beds extending in a transverse direction and disposed opposite to each other in a cross direction, at least either of which is capable of being racked in the transverse direction so that loops can be transferred between the front and back needle beds.

Knitwear such as, for example, the sweater having sleeves should be knitted in the manner that the gore of the front knitted fabric part is made larger than that of the back knitted fabric part and the front knitted fabric part is made smaller in lateral length than the back knitted fabric part, in order to suit one's figure. In this knitting, when the sleeve and the body are joined together, the joining starts after a boundary thereof on the joining side of the boundaries of the front knitted fabric parts and the back knitted fabric parts is located between the front needle bed and the back needle bed. Since the front knitted fabric part and the back knitted fabric part are different in size of the gore, after the formation of the gore, a reference boundary on the side opposite to the joining side of the boundaries of the front knitted fabric parts and the back knitted fabric parts, or a virtual center of the sleeve, is located on the front needle bed. In order to provide no twisting of loops formed after the formation of the gore, the virtual center of the sleeve located at the completion of the formation of the gore need be located at the same position with respect to the loops located at the end of the knitting width as it is located at the start of the knitting of the tubular knitted fabric.

Accordingly, in the present invention, a position of a reference boundary at the stage of the start of the knitting of the tubular knitted fabric is preset so that even when a boundary of the front knitted fabric part and the back knitted fabric part on the joining side is located between the front needle bed and the back needle bed via rotation operation at the stage of the start of the joining of a plurality of tubular knitted fabrics to form the gore therebetween, the reference boundary of the front knitted fabric part and the back knitted fabric part on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric. The position of the reference boundary is preset based on the difference in size of the gore knitted between the front knitted fabric part and the back knitted fabric part and on the rotation of the loops resulting from the difference in size of the gore therebetween.

With reference to this preset position of the reference boundary, the front knitted fabric part and the back knitted fabric part are knitted in a tubular form from the start of the knitting to a gore forming location, then a boundary thereof on the joining side is located between the front needle bed and the back needle bed via rotation operation, and then the gore is formed while the loops on the non-joining side located at the end of the knitting width and held on one needle bed on which the knitted fabric part of the small gore is knitted are transferred to the opposite needle bed by the rotation operation.

It should be noted that the knitted fabric whose front knitted fabric part and back knitted fabric part are different in length of the gore as disclosed herein includes a knitted fabric having a gore formed in either the front knitted fabric part or the back knitted fabric part. Also, the passage of "the stage of the start of the knitting of the tubular knitted fabric" disclosed herein indicates, in the case of the knitting of the sweater, for example, the stage of the start of the knitting of a cuff part of the sweater by a rib knitting or the stage of the start of the knitting of the sleeve of the sweater formed after the completion of the rib-knitting of the cuff part. In the case of the knitting of pants, this passage indicates the stage of the start of the knitting of an end part of the leg knitted by the rib knitting or the stage of the start of the knitting of the leg formed after the completion of the rib-knitting of the end part of the leg.

When two or more tubular knitted fabrics are joined together to form the gore therebetween, the boundary thereof on the side opposite to the joining side, of the boundaries of the front knitted fabric parts and the back knitted fabric parts of the tubular knitted fabrics, is taken as the reference boundary. Then, the position of this reference boundary at the stage of the start of the knitting of the tubular knitted fabric is preset so that the reference boundary located at the stage of the completion of the formation of the gore can be located at the same position with respect to the loops on the needle bed located at the end of the knitting width on the non-joining side as it is located at the stage of the start of the knitting of the tubular knitted fabric. The position of this reference boundary is properly preset depending on the difference in size of the gore between the front knitted fabric part and the back knitted fabric part knitted in accordance with a pattern of the knitted fabric knitted and on the rotation of the loops resulting from the difference in size of the gore therebetween.

For example when the sweater having the sleeves is knitted so that the front knitted fabric part can have a larger gore than the back knitted fabric part and also can have a smaller lateral length than the back knitted fabric part, the position of the reference boundary is preset as follows. The position of the reference boundary at the stage of the start of the knitting of the tubular knitted fabric is preset so that the reference boundary at the stage of the completion of the formation of the gore can be located at the same position with respect to the loops on the front needle bed located at the end of the knitting width as it is located at the stage of the start of the knitting of the sleeve.

Specifically, the position of the reference boundary at the stage of completion of the joining of the gore parts is determined from a pattern of the knitted fabric by counting the number of loops of the front knitted fabric part and the back knitted fabric part of each tubular knitted fabric at the stage of the completion of the joining of the gore parts. Then, from this position of the reference boundary at the stage of the completion of the joining of the gore parts, the position at which the reference boundary is located when the boundary on the joining side of the front knitted fabric part and the back knitted fabric part is located between the front needle bed and the back needle bed to start to form the gore is determined based on the number of loops of the gore parts of the front knitted fabric part and back knitted fabric part of the sleeve and on the difference in size of the gore between the front knitted fabric part and the back knitted fabric part. From the position of the reference boundary at the stage of the completion of the joining of the gore parts and the position of the same at the stage of the start of the formation of the gore, the rotation required for moving the reference boundary from the position at the stage of the start of the formation of the gore to the position at the stage of the completion of the joining of the gore parts is determined. Then, the position of the reference boundary at the stage of the start of the knitting of the tubular knitted fabrics is preset with reference to this rotation so that the position of the reference boundary at the start of the formation of the tubular knitted fabrics can be changed to the position of the same at the stage of the start of the formation of the gore via the rotation operation. Thus, the position of the reference boundary at the stage of the start of the knitting of the tubular knitted fabrics is preset with reference to the positions of the reference boundary in the respective process steps and the rotation, as described above.

When the above-said sweater is knitted, its front knitted fabric part and its back knitted fabric part are knitted to be equal in lateral length from after the start of the knitting until right before the formation of the gore. Therefore, when the virtual center serving as the reference boundary of the front and back knitted fabric parts is located on the front needle bed, the virtual side part serving as the boundary thereof on the opposite side is located on the back needle bed.

In the knitting of pants, the pants should be knitted in the manner that the gore of the back knitted fabric part is made larger than that of the front knitted fabric part and the back knitted fabric part is made larger in lateral length than the front knitted fabric part, in order to suit one's figure. In this knitting, at the stage of the start of the knitting of the tubular knitted fabrics, the boundary of the front knitted fabric part and the back knitted fabric part on the joining side is located on the front needle bed and also the boundary thereof on the non-joining side is located between the front needle bed and the back needle bed. Then, at the stage of the start of the formation of the gore, the rotation operation is performed so that the boundary thereof on the joining side can be located between the front needle bed and the back needle bed.

At the stage of the completion of the formation of the gore, the reference boundary of the front knitted fabric part and the back knitted fabric part on the side opposite to the joining side is located between the front needle bed and the back needle bed. In other words, after the completion of the formation of the gore, that reference boundary is returned to the position preset at the stage of the start of the knitting with respect to the loops on the needle bed located at the end of the knitting width.

Where the pants is knitted so that the back knitted fabric part can be made larger in lateral length than the front knitted fabric part, when the virtual side part of the leg part serving as the reference boundary of the front and back knitted fabric parts is located between the front needle bed and the back needle bed, the virtual crotch part of the leg part serving as the boundary thereof on the opposite side is located on the front needle bed.

In the knitting of the pants as well, the position of the reference boundary at the stage of the start of the knitting of the tubular knitted fabrics of the pants is preset with reference to the positions of the reference boundary at the stage of the start of the joining and at the stage of the completion of the joining and the rotation in the same manner as in the knitting of the sweater.

Then, with reference to the preset position, the front knitted fabric part and the back knitted fabric part are formed in a tubular form from the start of the knitting to a gore forming location and thereafter the gore is formed.

In the case of the sweater described above, the reference boundary described above is presented in the form of the virtual center of the sleeve, and the boundary of the front knitted fabric part and the back knitted fabric part on the side opposite to that virtual center is presented in the form of the virtual side part of the sleeve at a part thereof at which the knitting of the sleeve starts. At the stage of the start of the knitting of the sleeve, the front knitted fabric part and the back knitted fabric part are equal in lateral length. So, when the virtual center (reference boundary) of the sleeve is located on the front needle bed at that stage so that it can be located at the same position as it is located at the stage of the completion of the formation of the gore, the virtual side part of the sleeve is located on the back needle bed. From this state of things, the front knitted fabric part and the back knitted fabric part are formed in a tubular form by being knitted a number of courses, while the widening-loop operation is performed with reference to the virtual side part up to the gore forming location in accordance with a set knitting technique.

When the body and the sleeve are joined together, the sleeve is rotated so that the virtual side part can be located between the front needle bed and the back needle bed. As a result of this rotation, the virtual center (reference boundary) is rotated to the back needle bed until it is located, for example, between the front needle bed and the back needle bed. Then, the front knitted fabric parts and the back knitted fabric parts of the body and the sleeves are respectively joined with each other from their lateral ends to form a gore therebetween. At the stage of the completion of the formation of the gore, the virtual side part (reference boundary) is located at the same position with respect to the loops on the front needle bed located at the end of the knitting width as it is located at the stage of the start of the knitting of the tubular knitted fabrics.

In the case of the pants described above, the reference boundary described above is presented in the form of the virtual side part of the leg, and the boundary of the front knitted fabric part and the back knitted fabric part on the side opposite to that virtual side part is presented in the form of the virtual crotch part at a part thereof at which the knitting of the leg starts. At the stage of the start of the knitting of the leg, the front knitted fabric part is smaller in lateral length than the back knitted fabric part. So, when the virtual side part (reference boundary) is located between the front needle bed and the back needle bed so that it can be located at the same position as it is located at the stage of the completion of the formation of the gore, the virtual crotch part is located on the front needle bed. From this state of things, the front knitted fabric part and the back knitted fabric part are formed in a tubular form by being knitted a number of courses, while the widening-loop operation is performed with reference to the virtual crotch part up to the gore forming location in accordance with a set knitting technique.

When the legs are joined together, the leg is rotated so that the virtual crotch part can be located between the front needle bed and the back needle bed. As a result of this rotation, the virtual side part (reference boundary) is located on the front needle bed. Then, the front knitted fabric parts and the back knitted fabric parts of the legs are respectively joined with each other from their lateral ends to form a gore therebetween. At the stage of the completion of the formation of the gore, the virtual side part (reference boundary) is located between the front needle bed and the back needle bed that is the same position with respect to the loops on the needle bed located at the end of the knitting width as it is located at the stage of the start of the knitting.

The knitting method of the present invention is applicable to the knitting of the tubular knitted fabrics using four needle beds as well as the knitting using two needle beds.

Further, when three or more tubular knitted fabrics are joined together to form the tubular body and sleeves, they may be joined together on a two-by-two basis or on an at-a-stroke basis. For example, in the knitting of the knitted fabric having one tubular body and two tubular sleeves, both the right sleeve and the left sleeve may be joined to the body at the same time. Further, the knitting method of the present invention is also applicable to the joining of fingers of a glove to a body thereof.

The present invention provides a knitting program for controlling a computerized flat knitting machine to knit a knitted fabric having at least two tubular knitted fabrics, each comprising a front knitted fabric part and a back knitted fabric part which are continuously formed in a tubular form and the front knitted fabric parts and the back knitted fabric parts being respectively joined with each other from their lateral ends to form a gore therebetween in the manner that the gore of the front knitted fabric part and the gore of the back knitted fabric part can be made different in length. The computerized flat knitting machine is a knitting machine comprising at least a pair of front and back needle beds extending in a transverse direction and disposed opposite to each other in a cross direction, at least either of which is capable of being racked in the transverse direction so that loops can be transferred between the front and back needle beds. In the present invention, this program is used to control the flat knitting machine to knit knitted fabrics.

The knitting program of the present invention comprises a setting command and a knitting command. The setting command is a command that a position of a reference boundary at the stage of the start of the knitting of the tubular knitted fabric is preset so that even when a boundary of the front knitted fabric part and the back knitted fabric part on the joining side is located between the front needle bed and the back needle bed via rotation operation at the stage of the start of the joining of a plurality of tubular knitted fabrics to form the gore therebetween, the reference boundary of the front knitted fabric part and the back knitted fabric part on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric. In this case, the position of the reference boundary at the stage of the start of the knitting of the tubular knitted fabric is preset based on the difference in size of the gore knitted between the front knitted fabric part and the back knitted fabric part and on the rotation of the loops resulting from the difference in size of the gore therebetween.

The knitting command is a command that with reference to this setting command, the front knitted fabric part and the back knitted fabric part are knitted in a tubular form from the start of the knitting to a gore forming location, then a boundary thereof on the joining side is located between the front needle bed and the back needle bed via rotation operation, and then the gore is formed while the loops on the non-joining side located at the end of the knitting width and held on one needle bed on which the knitted fabric part of the small gore is knitted are transferred to the other needle bed via the rotation operation.

This knitting program is produced in CAD. The produced program is stored in recording media, such as a disc, for example, and the program stored in the recording media is read by a computer built in the flat knitting machine. Every mechanism of the flat knitting machine is driven in accordance with knitting commands from the knitting program, to knit the knitted fabric.

The CAD is constructed to include, for example, input means for entering shapes and sizes of a knitting pattern designed by a user, a memory for storing the knitted fabric's shapes and sizes entered by the input means, a memory in which required processes for the knitting including, for example, a bind-off process, a widening process, a narrowing process, and a flechage process are stored, program producing means for selecting a knitting process for knitting the knitted fabric from the knitting patterns stored in the memory and producing a knitting program for controlling the flat knitting machine to knit the knitted fabric with reference to the selected knitting pattern, and output means for outputting the produced program to the recording media.

The knitting pattern disclosed herein indicates, in the knitting of the sweater, for example, shapes of the respective parts of the sweater including a front body, a back body, a right sleeve, and a left sleeve.

Even when the knitted fabric comprising two or more tubular knitted fabrics joined together is knitted automatically with their front knitted fabric parts and back knitted fabric parts varied in size of gore, the knitting program can allow the loops to be formed continuously without twisting of the loops after the formation of the gores by controlling the knitting drive of the flat knitting machine under the knitting commands from the knitting program.

Effect of the Invention

The knitting method of the knitted fabric of the present invention can provide the result that when the gores of different in size are formed in the front knitted fabric and the back knitted fabric respectively, no twisting of the loops in the front and back knitted fabric parts can be provided at the completion of the joining of the gore parts. This can eliminate the need of the rotation operations being carried out many times after the formation of the gores for the subsequent knitting of the knitted fabric and the need of the operation to eliminate the twisting of the loops, and as such can allow the tubular knitted fabric to be knitted up continuously from the state of things after the formation of the gores. As a result of this, the knitting can be facilitated after the joining of the plurality of tubular knitted fabrics and the knitting time can be shortened. Further, good appearance and silhouette can be obtained.

BEST MODE FOR CARRYING OUT THE INVENTION

In the following, preferred embodiments of the present invention will be described with reference to the accompanying drawings. In the first and second embodiments illustrated below, knitwear is knitted using a so-called two-bed flat knitting machine having a pair of front and back needle beds extending in a transverse direction and disposed opposite to each other in a cross direction, the back needle bed being capable of being racked in the transverse direction so that loops can be transferred between the front and back needle beds.

The first embodiment related to a knitting method for a sweater having gores formed when the sleeves and the body are joined together, and the second embodiment relates to a knitting method for pants having a gore formed at the joining part of the right leg and the left leg.

When tubular knitwear is knitted using the two-bed flat knitting machine, it is knitted with every other needles of each of the front and back needle beds. For example, front knitted fabric parts of the knitwear, such as a front body and front knitted fabric parts of the sleeves, are knitted primarily with odd needles of the front needle bed, and back parts of the same, such as a back body and back knitted fabric parts of the sleeves, are knitted primarily with even needles of the back needle bed.

Further, when the two-bed flat knitting machine is used to knit the knitwear, the back knitted fabric parts are assigned to the needles of the back needle bed in the knitting of the front knitted fabric parts, while on the other hand, the front knitted fabric parts are assigned to the needles of the front needle bed in the knitting of the back knitted fabric parts, so that the front and back fabric parts are knitted with being overlapped in front and back. This can provide the result that the empty needles used for loop transfer of the respective knitted fabric parts can always be kept on the opposite needle beds.

Through the use of these empty needles, structure patterns of mixed front-and-back stitches, such as links, purl stitches, and ribs, can be knitted and the loops in the sleeves and the body can be transferred in the direction of the course so that the sleeves and the body can be joined to each other.

The two-bed flat knitting machine may be provided with a transfer jack bed(s) having transfer jacks arranged in line thereon and located over either or both of the front and back needle beds, for knitting the knitted fabrics.

As an alternative to the two-bed flat knitting machine used in the illustrated embodiments, a four-bed flat knitting machine comprising an upper front needle bed, a lower front needle bed, an upper back needle bed, and a lower back needle bed may be used for knitting.

When the four-bed flat knitting machine is used, for example the front knitted fabric parts are assigned to the lower front needle bed and the back knitted fabric parts are assigned to the lower back needle bed. Then, the empty needles on the upper back needle bed are used for loop transfer of the front knitted fabric parts and back stitch formation thereof and so on when the front knitted fabric parts are knitted, and the empty needles on the upper front needle bed are used for loop transfer of the back knitted fabric parts and back stitch formation thereof when the back knitted fabric parts are knitted.

First Embodiment

First, the first embodiment of the present invention will be described with reference to FIGS. 1 and 2. In the first embodiment, the two-bed flat knitting machine is used to knit the body and sleeves of the sweater in a seamless and continuous tubular form.

FIG. 1 is a plan view of parts of the sweater 1 of the knitwear whose front body and sleeves are viewed from the front body side, and FIG. 2 is a knitting process drawing of the sweater 1 knitted by a knitting method of the present invention, showing the respective knitting processes from the start of the knitting of the body and the sleeves.

The sweater 1 knitted in the first embodiment is a long-sleeved sweater with a neckline, having a front body 2*a*, a back body 2*b*, a left sleeve 3, and a right sleeve 4. The front body 2*a* and the back body 2*b* have a hem part 21, side parts 22, armhole parts 23, and a neckline part 24, as shown in FIG. 1. In the illustrated embodiment, the front body 2*a* and the back body 2*b* are different in upper shape above points A, a in FIG. 1 at which the formation of the armhole parts 23 starts.

In the illustrated embodiment, the front body 2*a* and the back body 2*b* are knitted in a tubular form to form the body, and the right sleeve and the left sleeve are each knitted in a tubular form. It is to be noted that in the first embodiment and the second embodiment, the terms to describe the right and left sides of the body, the sleeves and the legs used herein, such as, for example, the left sleeve 3 and the right sleeve 4, mean that they are on the right side and on the left side when viewed from a person putting on the sweater 1.

The knitting procedure of the sweater 1 of the embodiment is described below. In the embodiment, the back body 2*b*, the back knitted fabric parts of the left sleeve 3 and the right sleeve 4 are knitted primarily with even needles on the back needle bed, and the front body 2*a*, the front knitted fabric parts of the left sleeve 3 and the right sleeve 4 are knitted primarily with odd needles on the front needle bed.

For convenience of explanation, the knit structure of the front body 2*b*, back body 2*b* and sleeves 3, 4 of the sweater 1 is presented in the form of a plain knit structure with no pattern, and the knit structure of hem parts 21 of the front body 2*a* and back body 2*b* and the knit structure of cuff parts 31, 41 of the sleeves 3, 4 are presented in the form of a rib knit structure. However, the front body 2*a*, the back body 2*b*, the right sleeve 4 and the left sleeve 3 may have another knit structure, such as jacquard and rib.

First, three yarn feeders are prepared for the knitting of the body and the right and left sleeves, so that knitting yarns are fed from the respective yarn feeders to needles of the needle beds to knit three tubular bodies of the right sleeve, the body, and the left sleeve, respectively.

Specifically, the front body 2*a* and the back body 2*b* are knitted in a tubular form from the hems up to the joining starting location (A, a), as shown in FIG. 1. The left sleeve 3 and the right sleeve 4 are each knitted in a tubular form from the cuff parts up to the joining starting location (H, h). The body is knitted in the tubular form up to the joining location to the sleeves, with its lateral length unvaried, while on the other hand, the right and left sleeves are knitted to the joining location to the body, while being widened by the widening-loop operation.

Then, the joining of the body and the sleeves starts at A of the body, H of the left sleeve 3, a of the body, and h of the right sleeve 4. In the embodiment, the body and the sleeves are each knitted as a separate tubular knitted fabric until the start of the joining of the body and the sleeves.

In the embodiment, the gores are formed by A-B and a-b of the front body 2*a*, A-E and a-e of the back body 2*b*, H-I of the front knitted fabric part of the left sleeve 3, H-K of the back knitted fabric part of the left sleeve 3, h-i of the front knitted fabric part of the right sleeve 4, and h-k of the back knitted fabric part of the right sleeve 4. A-B of the front body 2*a* and H-I of the front knitted fabric part of the left sleeve 3 are joined together, and a-b of the front body 2*a* and h-i of the front knitted fabric part of the right sleeve 4 are joined together. Further, A-E of the back body 2*b* and H-K of the back knitted fabric part of the left sleeve 3 are joined together, and a-e of the back body 2*b* and h-k of the back knitted fabric part of the right sleeve 4 are joined together. In the illustrated embodiment, the gores of the front knitted fabric parts are made larger in length than those of the back knitted fabric parts. When the joining of the gore parts is completed, the body and the sleeves are combined as a single tubular body.

The armhole part 23 of the body is formed to extend from upper ends (A, a of FIG. 1) of the side parts 22 of the front body 2*a* to locations (D, d) of the front body 2*a* and from upper ends (A, a of FIG. 1) of the side parts of the back body 2*b* to locations (F, f) of the back body 2*b*. In the embodiment, the front body 2*a* and the right and left sleeves are joined together in the following manner. After B of the armhole part 23 and I of the left sleeve 3 are joined together and b of the armhole part 23 and i of the right sleeve 4 are joined together, B-C of the armhole part 23 and I-J of the left sleeve 3, C-D of the armhole part 23 and J-M of the left sleeve 3, b-c of the armhole part 23 and i-j of the right sleeve 4, and c-d of the armhole part 23 and j-m of the right sleeve 4 are joined together, respectively. Also, the back body 2*b* and the right and left sleeves are joined together in the following manner. After E of the armhole part 23 and K of the left sleeve 3 are joined together and e of the armhole part 23 and k of the right sleeve 4 are joined together, E-F of the armhole part 23 and K-M of the left sleeve 3 and e-f of the armhole part 23 and k-m of the right sleeve 4 are joined together, respectively.

After completion of the joining of the body and the sleeves, D-G of the front body 2*a* and F-G of the back body 2*b*, and d-g of the front body 2*a* and f-g of the back body 2*b* are joined together, respectively, to form shoulders of the sweater 1, with which the sweater 1 is completed.

The illustrated embodiment relates to a knitting method for a knitted fabric having a gore part between the front knitted fabric parts of the body and sleeves larger (in number of wales) than a gore part between the back knitted fabric parts of the body and sleeves. In the following, the knitting processes from the start of the knitting of the body and the sleeves to the end of the formation of the gores and in turn to the knitting process for the continuous knitting of the body and the sleeves are described with reference to FIG. 2 showing the knitting processes. The numerals at the left side of FIG. 2 indicate the respective steps of the knitting processes.

The step 1 shown in FIG. 2 shows the state of the body and the right and left sleeves started to be knitted in a tubular form separately (the stage of completion of the knitting of the cuff parts). The body is knitted in the center and the right and left sleeves are knitted at both sides thereof. In FIG. 2, boundaries of the front body 2*a* and the back body 2*b* of the body are indicated by Z. Boundaries of the front knitted fabric parts 3*a*, 4*a*, and the back knitted fabric parts 3*b*, 4*b* of the right and left sleeves 3, 4 are indicated by X and Y. The boundary X is a reference boundary of the present invention. In the illustrated embodiment, this reference boundary X is taken as a virtual center of the sleeve, and the boundary Y of the sleeve on the joining side is taken as a virtual side part thereof.

In the step 1, the boundaries Z of the body are located between the front needle bed and the back needle bed. The reference boundary X of the sleeve is located inward of the loop located at the end of the knitting width on the side opposite to the joining side on the front needle bed. The boundary Y is located inward of the loop, of the loops held on the needle bed, located at the end of the knitting width on the joining side. Thus, in this step, the right and left sleeves are put in the state in which their front knitted fabric parts are partly rotated to the back needle bed and their back knitted fabric parts are partly rotated to the front needle beds. The reference boundary X at this stage is located in the same position as it is located at the stage of the completion of the formation of the gore mentioned later when counted from the loop, of the loops held on the needle bed, located at the end of the knitting width on the non-joining side.

The step 2 shows the state of the front and back knitted fabric parts of the right and left sleeves being widened the same number of loops with reference to the boundaries Y. The step 3 shows the state thereof after the loop-widening operation is repeatedly performed in the step 2. In this state also, the reference boundary X is located in the same position when counted from the loop, of the loops held on the needle bed, located at the end of the knitting width on the side opposite to the joining side.

The step 4 shows the state of the right and left sleeves being moved to the body while being rotated via the racking of the needle bed and the loop transfer. In the step 4, the reference boundaries X and the boundaries Y of the right and left sleeves are positioned between the front needle bed and the back needle bed. In the step 4, the gores are formed by A-B and a-b of the front body 2*a*, A-E and a-e of the back body 2*b*, H-I of the front knitted fabric part 3*a* of the left sleeve 3, H-K of the back knitted fabric part 3*b* of the left sleeve 3, h-i of the front knitted fabric part 4*a* of the right sleeve 4, and h-k of the back knitted fabric part 4*b* of the right sleeve 4.

The step 5 shows the state at the stage at which the front knitted fabric parts and the back knitted fabric parts were respectively jointed to each other at their gore parts and then bound off by the binding-off process to form the gores. In the illustrated embodiment, the gores of the front knitted fabric parts are larger in size than those of the back knitted fabric parts, in other words, the back knitted fabric parts are larger in lateral length than the front knitted fabric parts, due to which the back knitted fabric parts of the sleeves are partly rotated from the back needle bed to the front needle bed in the process of the joining of the gore parts. As a result of this rotation, the reference boundaries X are located in the same positions at the stage of the completion of the formation of the gores as they are located at the stage of the start of the knitting in step 1 when counted from the loop located at the end of the knitting width on the side opposite to the joining side of the loops held on the needle bed. Thus, the loops on the center side of the sleeves are put in the same state at the stage of the completion of the knitting of the step 5 as they are put at the stage of the start of the knitting, so that no twisting of the loops is provided. In the embodiment, there is no need to consider the twisted loops when the body and the sleeves are knitted in a single tubular form while being joined together. Hence, the body and the sleeves can be knitted in a single tubular form continuously from after the completion of the formation of the gores, as shown in the step 6.

Second Embodiment

Next, the second embodiment of the present invention is described with reference to FIGS. 3 and 4. As shown in FIG. 3, the pants 5 knitted in the second embodiment comprises a right leg 51, a left leg 52 and a body 53, and gores 54, 55 are formed at joining parts of the right leg 51 and the left leg 52. In this embodiment, the right leg 51 and the left leg 52 are formed so that their front knitted fabric parts are made smaller in lateral length as well as in size of the gore than their back knitted fabric parts. In the illustrated embodiment, the right leg 51 and the left leg 52 are each knitted in a tubular form and are joined together at the body 53.

The knitting procedure of the pants 5 is concretely described below. In this embodiment also, the back knitted fabric parts of the right leg 51 and the left leg 52 are knitted primarily with even needles on the back needle bed, and the front knitted fabric parts of the same are knitted primarily with odd needles on the front needle bed. For convenience of explanation, the knit structure of the right leg 51 and the left leg 52 of the pants 5 are presented in the form of a plain knit structure with no pattern.

First, two yarn feeders are prepared for the knitting of the right leg 51 and the left leg 52, so that knitting yarns are fed from the respective yarn feeders to the needles of the needle beds to knit two tubular bodies of the right leg 51 and the left leg 52 up to a crotch part.

Then, the right leg 51 and the left leg 52 start being joined together at the crotch part to form the gores therebetween. After completion of the formation of the gores, the right leg 51 and the left leg 52 are combined as a single tubular body. The single tubular body is formed into the body 53. In the illustrated embodiment, the body 53 is knitted while the crotch part of the right leg 51 and the crotch part of the left leg 52 are joined together.

Next, the knitting processes are described below with reference to FIG. 4 showing the knitting processes from the start of the knitting of the right leg 51 and the left leg 52 to the end of the formation of the gores to knit the single tubular knitted fabric. The numerals at the left side of FIG. 4 indicate the respective steps of the knitting processes.

The step 1 shown in FIG. 4 shows the state of the right leg 51 and the left leg 52 started to be knitted in a tubular form separately. In FIG. 4, boundaries of the front knitted fabric parts 51*a*, 52*a* of the right and left legs 51, 52 and the back knitted fabric parts 51*b*, 52*b* of the same are indicated by X, Y. The boundary X indicates the reference boundary of the present invention, and the boundary Y indicates the boundary on the joining side. In the illustrated embodiment, the reference boundary X is taken as a virtual side part of the leg, and the boundary Y is taken as a virtual crotch part thereof.

In the step 1, the boundary X of each leg is located between the front needle bed and the back needle bed, and the reference boundary Y of the same is located inward of the loop located at the end on the joining side on the front needle bed. Thus, in this step, the right and left legs are put in the state in which their back knitted fabric parts are partly rotated to the front needle bed. The reference boundary X at this stage is located between the front needle bed and the back needle bed, as is the case of being located at the stage of the completion of the formation of the gores mentioned later.

The step 2 shows the state of the front and back knitted fabric parts being widened the same number of loops with reference to the boundaries Y. The step 3 shows the state thereof after the loop-widening operation is repeatedly performed in the step 2. In this state also, the reference boundary X is located between the front needle bed and the back needle bed.

The step 4 shows the state of the right and left legs being moved to each other while being rotated via the racking of the needle bed and the loop transfer. In the step 4, as a result of the rotation operation, the reference boundaries X of the right and left legs are positioned on the front needle bed and the boundaries Y of the same are positioned between the front needle bed and the back needle bed. Thus, in this state, the back knitted fabric parts are partly moved to the front needle bed. In the step 4, the size of the gore of the front knitted fabric part is defined by the region indicated by reference numeral 54, and the size of the gore of the back knitted fabric part is defined by the region indicated by reference numeral 55.

The step 5 shows the state at the stage at which the front knitted fabric parts and the back knitted fabric parts were respectively jointed to each other at their gore parts to form the gore. In the illustrated embodiment, the gores of the back knitted fabric parts are larger in size than those of the front knitted fabric parts, due to which the back knitted fabric parts held on the front needle bed are partly rotated back to the back needle bed in the process of the joining of the gore parts. As a result of this rotation, the reference boundaries X are located between the front needle bed and the back needle bed and thus located in the same positions at the stage of the completion of the formation of the gores as they are located at the stage of the start of the knitting in the step 1. Thus, the loops on the side of the legs are put in the same state at the stage of the completion of the knitting of the step 5 as they are put at the stage of the start of the knitting, so that no twisting of the loops is provided. In the embodiment, there is no need to consider the twisted loops when the right and left legs are knitted in a single tubular form while being joined together. Hence, the legs can be knitted in a single tubular form continuously from after the completion of the formation of the gores, as shown in the step 6.

In the embodiments illustrated above, the knitting programs for executing the knitting methods of the embodiments described above are produced, under which the knitting machine is controlled for the knitting. In the embodiments, this knitting program is produced in CAD. The produced program is stored in recording media such as a disc and the program stored in the recording media is read by a computer built in the flat knitting machine. Every mechanism of the flat knitting machine is driven in accordance with knitting commands from the knitting program, to knit the knitted fabric.

The CAD is constructed to include, input means for entering shapes and sizes of a knitting pattern designed by a user, a memory for storing the knitted fabric's shapes and sizes entered by the input means, a memory in which required processes for the knitting including, for example, a bind-off process, a widening process, a narrowing process, and a flechage process are stored, program producing means for selecting a knitting process for knitting the knitted fabric from the knitting patterns stored in the memory and producing a knitting program for controlling the flat knitting machine to knit the knitted fabric with reference to the selected knitting pattern, and output means for outputting the produced program to the recording media.

The program producing means produces programs of setting commands and knitting commands. The setting command is programmed to issue a command that a position of a reference boundary at the stage of the start of the knitting of the tubular knitted fabric is preset so that even when the boundary of the front knitted fabric part and the back knitted fabric part on the joining side is located between the front needle bed and the back needle bed via rotation operation at the stage of the start of the joining of a plurality of tubular knitted fabrics to form the gore therebetween, the reference boundary of the front knitted fabric part and the back knitted fabric part on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric. The position of the reference boundary is preset based on the difference in size of the gore knitted between the front knitted fabric part and the back knitted fabric part and on the rotation of the loops resulting from the difference in size of the gore therebetween.

The knitting command is programmed to issue a command that the front knitted fabric part and the back knitted fabric part are knitted in a tubular form from the start of the knitting to a gore forming location, then a boundary thereof on the joining side is located between the front needle bed and the back needle bed via rotation operation, and then the gore is formed while the loops on the non-joining side located at the end of the knitting width and held on one needle bed on which the knitted fabric part of the small gore is knitted are transferred to the other needle bed via the rotation operation.

In the illustrated embodiments, the knitting commands are read from the recording media storing the knitting programs therein by the computer built in the flat knitting machine, and the knitted fabric is knitted by the flat knitting machine in accordance with the knitting commands read. This enables the joining of the tubular knitted fabrics whose front knitted fabric parts and back knitted fabric parts are different in size of the gore and the sequent tubular knitting after the joining without any twisting of the loops, and as such can automatically knit the knitted fabric of beautiful appearance when wearing.

INDUSTRIAL APPLICABILITY

The knitting method and the knitting program of the present invention are suitably used for joining together tubular knitted fabrics whose front knitted fabric part and back knitted fabric part are different in size of the gore in a seamless manner.

EXPLANATION OF LETTERS OR NUMERALS

Figure 1:
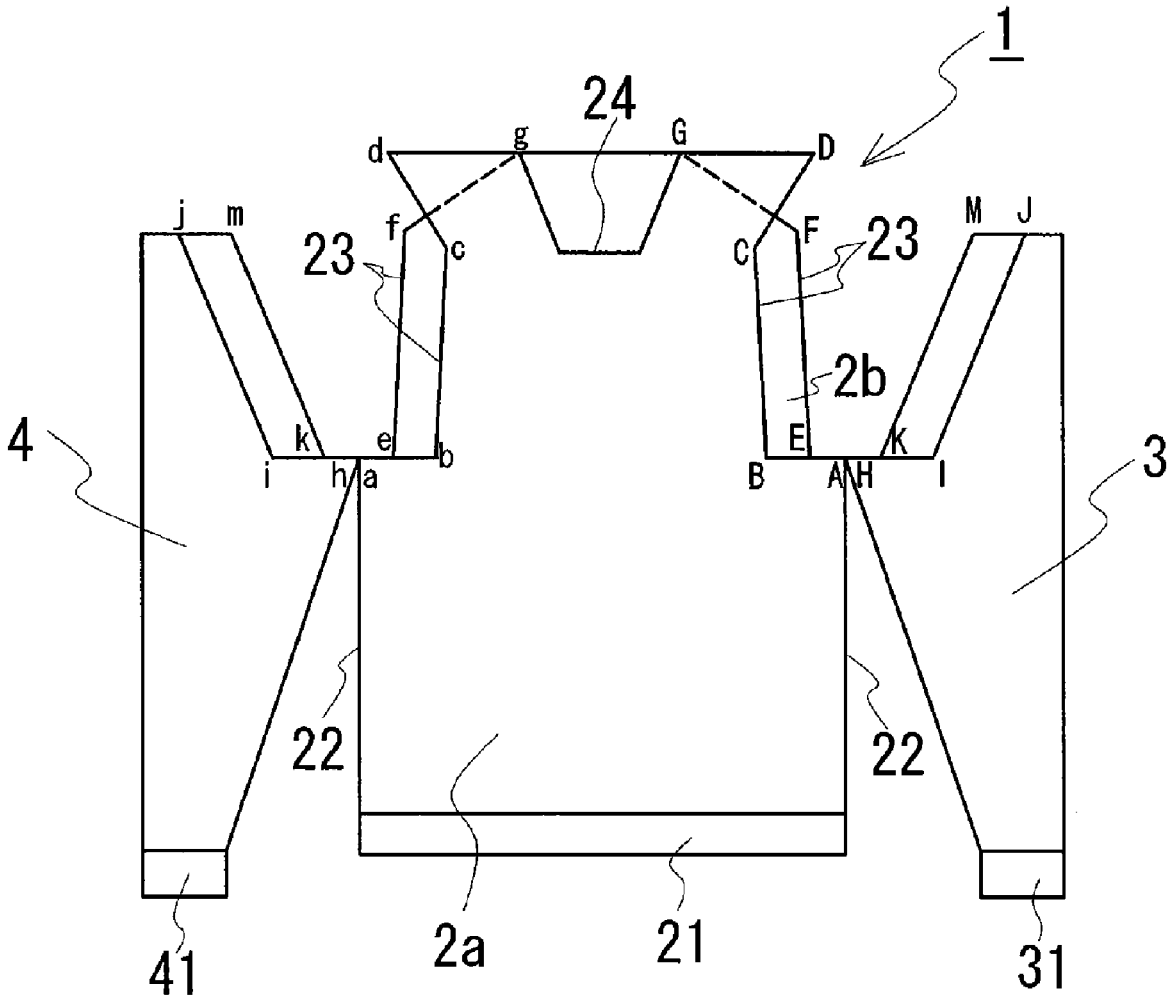
FIG. 1 is a plan view of parts of a sweater in which gores are formed.
Figure 2:
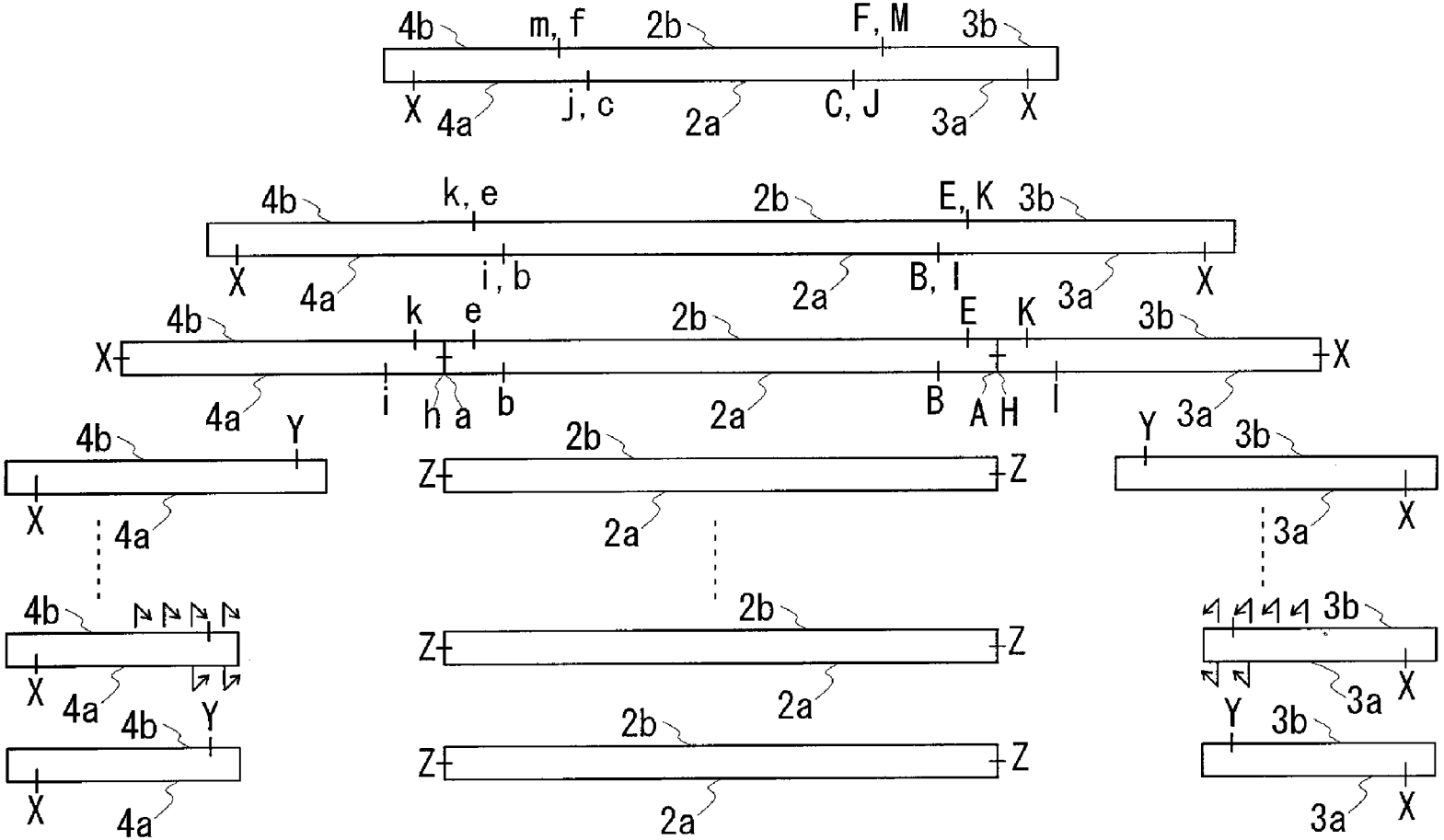
FIG. 2 is a knitting process drawing of the sweater in which the gores are formed.
Figure 3:
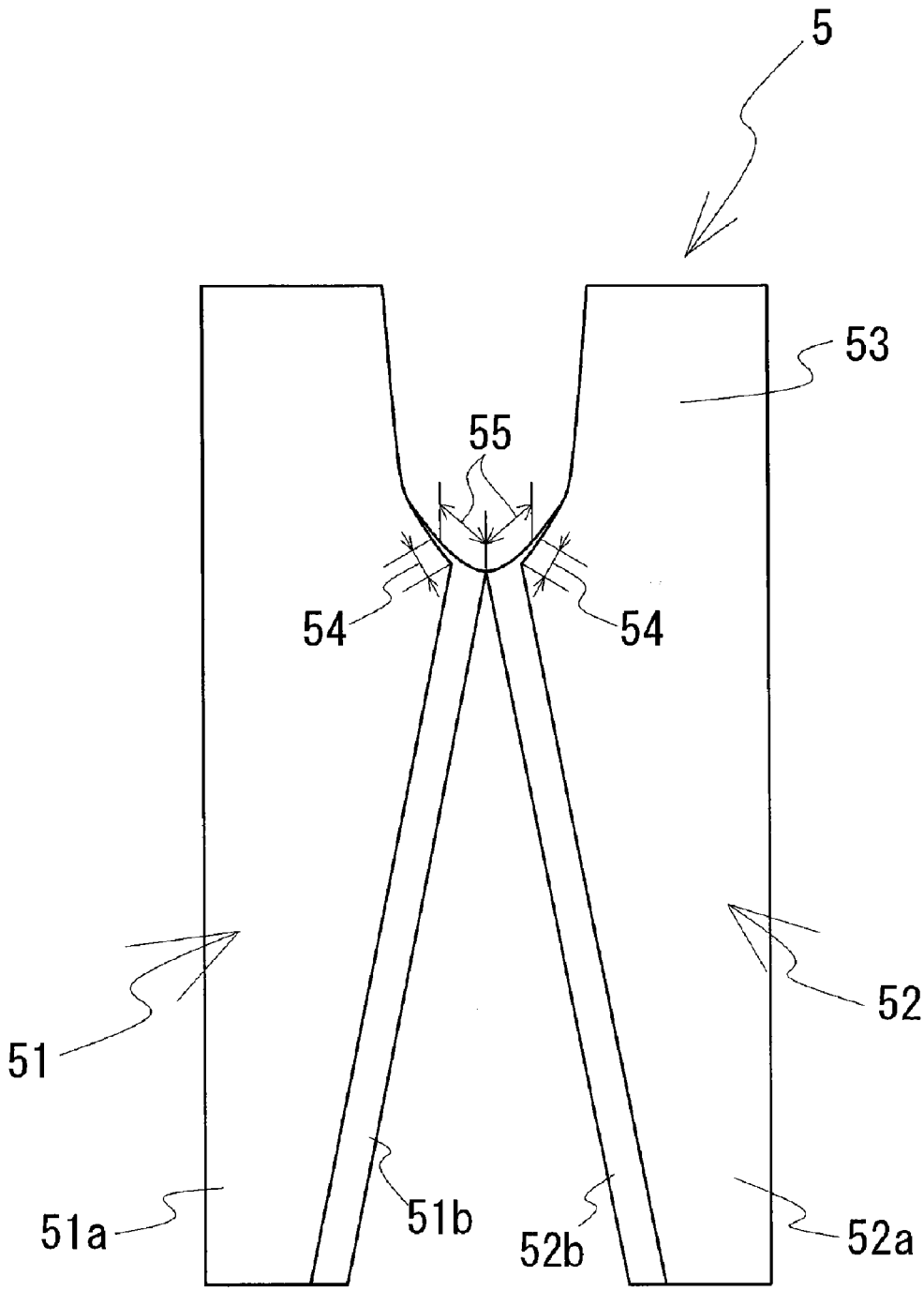
FIG. 3 is a plan view of parts of pants in which gores are formed.
Figure 4:
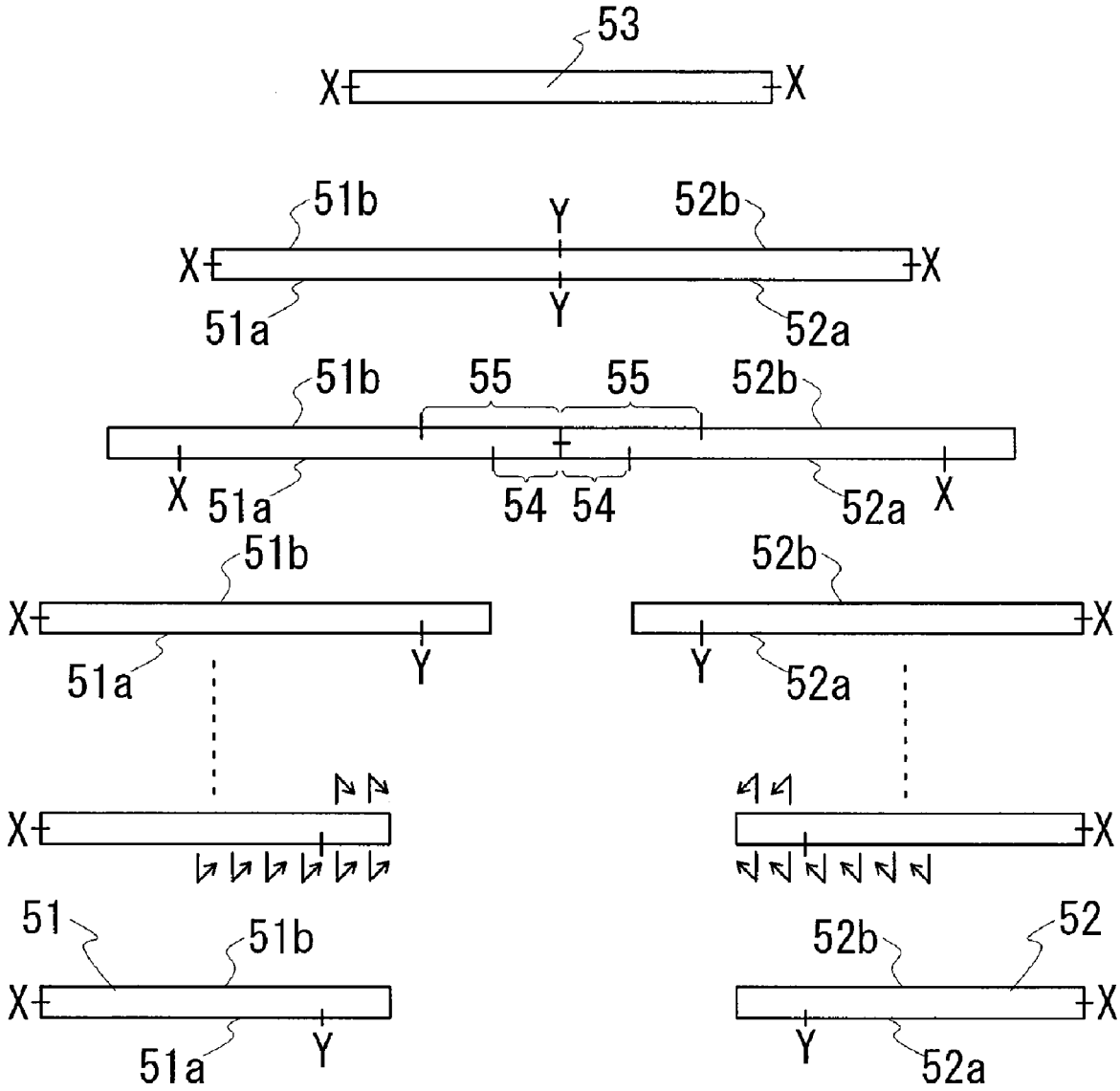
FIG. 4 is a knitting process drawing of the pants in which the gores are formed.

| | | |
|---|---|---|
| 1: Sweater | 2a: Front body | 2b: Back body |
| 21: Hem part | 22: Side part | 23: Armhole part |
| 24: Neckline part | 3: Left sleeve | 4: Right sleeve |
| 31, 41: Cuff part | 5: Pants | 51: Right leg |
| 52: Left leg | 53: Body | 54: Gore of front knitted fabric part |
| 55: Gore of back knitted fabric part | | |

The invention claimed is:

1. A knitting method for knitting a knitted fabric by using a flat knitting machine having at least a pair of front and back needle beds extending in a transverse direction and disposed opposite to each other in a cross direction, at least either of which is capable of being racked in the transverse direction so that loops can be transferred between the front and back needle beds, wherein the knitted fabric has at least two tubular knitted fabrics, each comprising a front knitted fabric part and a back knitted fabric part which are continuously formed in a tubular form, the front knitted fabric parts and the back knitted fabric parts are respectively joined with each other from their lateral ends to form a gore therebetween in the manner that the gore of the front knitted fabric part and the gore of the back knitted fabric part can be made different in length, the method comprising the steps of:

presetting a position of a reference boundary at a stage of the start of the knitting of the tubular knitted fabric based on a difference in size of the gore knitted between the front knitted fabric part and the back knitted fabric part and on rotation of the loops determined by the difference in size of the gore therebetween so that even when a boundary of the front knitted fabric part and the back knitted fabric part on the joining side is located between the front needle bed and the back needle bed via rotation operation at the stage of the start of the joining of a plurality of tubular knitted fabrics to form the gore therebetween, the reference boundary of the front knitted fabric part and the back knitted fabric part on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric, knitting the front knitted fabric part and the back knitted fabric part in a tubular form from the start of the knitting to a gore forming location with reference to this preset position of the reference boundary, rotating the front knitted fabric part and the back knitted fabric part to locate the boundary thereof on the joining side between the frond needle bed and the back needle bed; and forming the gore while the loops on the non-joining side located at the end of the knitting width and held on one needle bed on which the knitted fabric part of the small gore is knitted are transferred to the other needle bed via the rotation operation.

2. The knitting method of the knitted fabric according to claim 1, wherein the knitted fabric knitted is a knitted fabric having right and left tubular sleeves and a tubular body to which the sleeves are joined, and the gore of the front knitted fabric part of the sleeves and body is larger than the gore of the back knitted fabric part of the same.

3. The knitting method of the knitted fabric according to claim 1, wherein the knitted fabric knitted is a knitted fabric having right and left tubular legs and a tubular body formed by joining together a part of the legs, and the gore of the back knitted fabric part is larger than the gore of the front knitted fabric part.

4. A computer-readable medium storing executable instructions for controlling a computerized flat knitting machine having at least a pair of front and back needle beds extending in a transverse direction and disposed opposite to each other in a cross direction, at least either of which is capable of being racked in the transverse direction so that loops can be transferred between the front and back needle beds, to knit a knitted fabric having at least two tubular knitted fabrics, each comprising a front knitted fabric part and a back knitted fabric part which are continuously formed in a tubular form and the front knitted fabric parts and the back knitted fabric parts being respectively joined with each other from their lateral ends to form a gore therebetween in the manner that the gore of the front knitted fabric part and the gore of the back knitted fabric part can be made different in length, by performing operations comprising:

a setting command that a position of a reference boundary at a stage of the start of the knitting of the knitted fabric part is preset based on a difference in size of the gore knitted between the front knitted fabric part and the back knitted fabric part and on rotation of the loops resulting from the difference in size of the gore therebetween so that even when a boundary of the front knitted fabric part and the back knitted fabric part on the joining side is located between the front needle bed and the back needle bed via rotation operation at the stage of the start of the joining of a plurality of tubular knitted fabrics to form the gore therebetween, the reference boundary of the front knitted fabric part and the back knitted fabric part on the side opposite to the joining side located at the stage of the completion of the formation of the gore can be located at the same position with respect to the loops on the needle bed located at the end of the knitting width on the non-joining side as it is located at the stage of the start of the knitting of the tubular knitted fabric, and a knitting command that with reference to this preset command, the front knitted fabric part and the back knitted fabric part are knitted in a tubular form from the start of the knitting to a gore forming location, then a boundary thereof on the joining side is located between the front needle bed and the back needle bed via rotation operation, and then the gore is formed while the loops on the non-joining side located at the end of the knitting width and held on one needle bed on which the knitted fabric part of the small gore is knitted are transferred to the other needle bed via the rotation operation.

* * * * *